US012610986B2

(12) United States Patent
Lei et al.

(10) Patent No.: US 12,610,986 B2
(45) Date of Patent: Apr. 28, 2026

(54) VAPORIZATION ASSEMBLY AND ELECTRONIC VAPORIZATION DEVICE

(71) Applicant: SHENZHEN SMOORE TECHNOLOGY LIMITED, Shenzhen (CN)

(72) Inventors: Guilin Lei, Shenzhen (CN); Boxue Gong, Shenzhen (CN); Zhouwei Chen, Shenzhen (CN); Guanghui Li, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 429 days.

(21) Appl. No.: 18/174,874

(22) Filed: Feb. 27, 2023

(65) Prior Publication Data

US 2023/0218008 A1 Jul. 13, 2023

Related U.S. Application Data

(63) Continuation of application No. PCT/CN2020/112672, filed on Aug. 31, 2020.

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
CPC ..... A24F 40/42; A24F 40/485
See application file for complete search history.

(56) References Cited

U.S. PATENT DOCUMENTS

| | | | | |
|---|---|---|---|---|
| 10,188,148 | B2 * | 1/2019 | Althorpe | A61M 15/06 |
| 11,083,224 | B2 * | 8/2021 | Lin | A24F 40/48 |
| 2014/0109921 | A1 | 4/2014 | Chen | |
| 2016/0073694 | A1 | 3/2016 | Liu | |

(Continued)

FOREIGN PATENT DOCUMENTS

| | | | |
|---|---|---|---|
| CN | 2804772 | Y | 8/2006 |
| CN | 203523810 | U | 4/2014 |

(Continued)

OTHER PUBLICATIONS

Chinese Patent Office, Office Action in Chinese Patent Application No. 202010899227.X (Sep. 26, 2024).

(Continued)

*Primary Examiner* — Russell E Sparks
(74) *Attorney, Agent, or Firm* — Leydig, Voit & Mayer, Ltd.

(57) ABSTRACT

A vaporization assembly includes: a vaporization sleeve having a liquid storage cavity for storing liquid; and a mounting base embedded in the vaporization sleeve, a first liquid flowing channel and a second liquid flowing channel being provided in the mounting base in a direction facing the liquid storage cavity. In the first liquid flowing channel and the second liquid flowing channel, a plurality of guide grooves are provided only on a wall surface of the first liquid flowing channel so as to cause the first liquid flowing channel and the second liquid flowing channel to be asymmetrical in structure.

13 Claims, 12 Drawing Sheets

(56) References Cited

U.S. PATENT DOCUMENTS

| | | | | |
|---|---|---|---|---|
| 2017/0325503 | A1 | 11/2017 | Liu | |
| 2019/0231991 | A1 | 8/2019 | Tsai et al. | |
| 2020/0060344 | A1 | 2/2020 | Tan et al. | |
| 2020/0128874 | A1* | 4/2020 | Atkins | A24F 40/48 |
| 2021/0219606 | A1 | 7/2021 | Lahound et al. | |

FOREIGN PATENT DOCUMENTS

| | | | |
|---|---|---|---|
| CN | 105105339 | A | 12/2015 |
| CN | 106037011 | A | 10/2016 |
| CN | 208550022 | U | 3/2019 |
| CN | 110250578 | A | 9/2019 |
| CN | 110403246 | A | 11/2019 |
| CN | 110613171 | A | 12/2019 |
| CN | 110613172 | A | 12/2019 |
| CN | 110623308 | A | 12/2019 |
| CN | 110638101 | A | 1/2020 |
| CN | 110893016 | A | 3/2020 |
| CN | 111109664 | A | 5/2020 |
| CN | 210471007 | U | 5/2020 |
| CN | 112021671 | A | 12/2020 |
| CN | 212728792 | U | 3/2021 |
| CN | 212937921 | U | 4/2021 |
| CN | 113786011 | A | 12/2021 |
| CN | 216931892 | U | 7/2022 |
| DE | 102017123869 | A1 | 4/2019 |
| JP | 2008281086 | A | 11/2008 |
| KR | 1020200070268 | A | 6/2020 |
| WO | 2015043126 | A1 | 4/2015 |
| WO | 2015161407 | A1 | 10/2015 |
| WO | 2018032427 | A1 | 2/2018 |
| WO | 2018054064 | A1 | 3/2018 |
| WO | 2018188616 | A1 | 10/2018 |
| WO | 2022041241 | A1 | 3/2022 |

OTHER PUBLICATIONS

Chinese Patent Office, Office Action in Chinese Patent Application No. 202010899246.2 (Oct. 8, 2024).

Patent Cooperation Treaty, International Search Report and Written Opinion, International Application No. PCT/CN2020/112672 (May 28, 2021).

Patent Cooperation Treaty, International Search Report and Written Opinion, International Application No. PCT/CN2021/113841 (Apr. 28, 2022).

Patent Cooperation Treaty, International Search Report and Written Opinion, International Application No. PCT/CN2020/112674 (May 26, 2021).

Chinese Patent Office, First Office Action in Chinese Patent Application No. 202121975643.X (Feb. 9, 2022).

European Patent Office, Search Report in European Patent Application No. 20950910.8 (Feb. 5, 2024).

Chinese Patent Office, Office Action in Chinese Patent Application No. 202010899227.X (Mar. 6, 2025).

Chinese Patent Office, Office Action in Chinese Patent Application No. 202110961223.4 (Dec. 25, 2024).

European Patent Office, Search Report in European Patent Application No. 20950911.6 (Oct. 11, 2023).

Chinese Patent Office, Office Action in Chinese Patent Application No. 202010899227.X (May 14, 2025).

Chinese Patent Office, Notification of grant of patent right for invention in Chinese Patent Application No. 202110961223.4 (May 28, 2025).

* cited by examiner

VAPORIZATION ASSEMBLY AND ELECTRONIC VAPORIZATION DEVICE

CROSS-REFERENCE TO PRIOR APPLICATION

This application is a continuation of International Patent Application No. PCT/CN2020/112672, filed on Aug. 31, 2020. The entire disclosure is hereby incorporated by reference herein.

FIELD

This application relates to the technical field of vaporization products, and in particular, to a vaporization assembly and an electronic vaporization device.

BACKGROUND

A vaporization assembly is a device that vaporizes liquid (such as e-liquid) into vapor, and is widely used in various fields, such as medical treatment, e-cigarettes, etc.

Currently, the vaporization assembly generally includes a vaporization sleeve, a mounting base, and a vaporization core. The vaporization sleeve includes a liquid storage cavity storing liquid, the mounting base is embedded in the vaporization sleeve, and the vaporization core is arranged on a side surface of the mounting base and is configured to vaporize the liquid flowing into the vaporization core, where the side surface is away from the vaporization cavity. Specifically, a liquid flowing channel is provided on the mounting base, and the liquid in the liquid storage cavity may flow through the liquid flowing channel into the vaporization core.

However, in the existing vaporization assembly, bubbles generated by ventilation tend to stay in and block the liquid flowing channel of the mounting base, thereby affecting the ventilation performance of the vaporization assembly and preventing the liquid from entering the vaporization core.

SUMMARY

In an embodiment, the present invention provides a vaporization assembly, comprising: a vaporization sleeve comprising a liquid storage cavity configured to store liquid; and a mounting base embedded in the vaporization sleeve, a first liquid flowing channel and a second liquid flowing channel being provided in the mounting base in a direction facing the liquid storage cavity, wherein, in the first liquid flowing channel and the second liquid flowing channel, a plurality of guide grooves are provided only on a wall surface of the first liquid flowing channel so as to cause the first liquid flowing channel and the second liquid flowing channel to be asymmetrical in structure.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
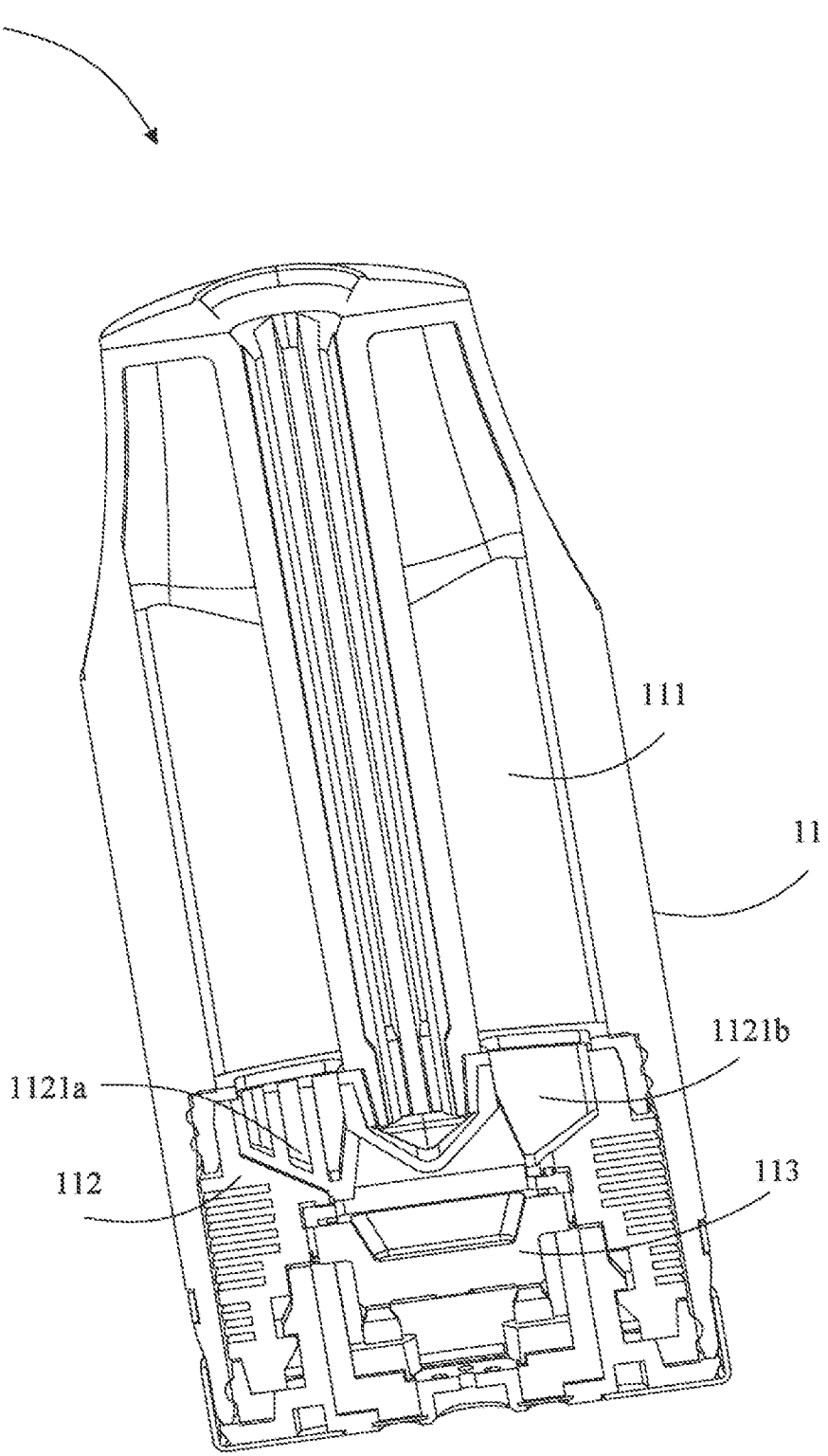
FIG. 1 is a schematic structural diagram of a vaporization assembly according to an embodiment of this application.

In an embodiment, the present invention provides a vaporization assembly and an electronic vaporization device, the vaporization assembly can resolve a problem that bubbles generated by ventilation tend to stay in and block a liquid flowing channel of a mounting base, and affect the ventilation performance of the vaporization assembly and prevent liquid from entering a vaporization core.

In an embodiment, the present invention provides a vaporization assembly. The vaporization assembly includes a vaporization sleeve and a mounting base; the vaporization sleeve includes a liquid storage cavity configured to store liquid; and the mounting base is embedded in the vaporization sleeve, where a first liquid flowing channel and a second liquid flowing channel are provided in the mounting base in a direction facing the liquid storage cavity; and in the first liquid flowing channel and the second liquid flowing channel, several guide grooves are provided only on the wall surface of the first liquid flowing channel, to cause the first liquid flowing channel and the second liquid flowing channel to be asymmetrical in structure.

The vaporization assembly further includes a vaporization core, where the guide grooves guide the liquid in the liquid storage cavity toward the vaporization core by a capillary force.

The wall surface of the second liquid flowing channel is a smooth wall surface. The width of each guide groove is less than 1.5 mm.

The vaporization assembly further includes several other liquid flowing channels, where the guide grooves are provided in all or a part of the several other liquid flowing channels.

The vaporization assembly further includes several other liquid flowing channels, where the wall surfaces of the several other liquid flowing channels are smooth wall surfaces.

The guide grooves are formed by arrangement at intervals of several liquid guiding walls protruding from the inner surface of the first liquid flowing channel, and the several liquid guiding walls extend in the axial direction of the first liquid flowing channel.

Each liquid guiding wall includes a first side and a second side opposite to the first side, and the side wall of the first liquid flowing channel includes a first inner surface and a second inner surface opposite to the first inner surface; and the first side of each liquid guiding wall is connected with one of the first inner surface and the second inner surface, and the second side of each liquid guiding wall is arranged apart from the other of the first inner surface and the second inner surface.

Each liquid guiding wall further includes a third side and a fourth side that are adjacent to the first side; and the third side of each liquid guiding wall is flush with or lower than the first surface of the mounting base.

The fourth side of each liquid guiding wall is connected with the inner surface of the bottom wall of the first liquid flowing channel.

Each liquid guiding wall includes a first side and a second side opposite to the first side, and the side wall of the first liquid flowing channel includes a first inner surface and a second inner surface opposite to the first inner surface; in some liquid guiding walls, the first sides are connected with the first inner surface, and the second sides are arranged apart from the second inner surface; and in the remaining liquid guiding walls, the first sides are connected with the second inner surface, the second sides are arranged apart from the first inner surface, and the liquid guiding walls on the first inner surface and the liquid guiding walls on the second inner surface are arranged in an opposite or a staggered manner.

Each liquid guiding wall includes a first side, a second side opposite to the first side, and a third side and a fourth side that are adjacent to the first side, and the side wall of the first liquid flowing channel includes a first inner surface and a second inner surface opposite to the first inner surface; and the first side and the second side of each liquid guiding wall are respectively connected with the first inner surface and the second inner surface of the first liquid flowing channel, the third side of each liquid guiding wall is flush with or lower than the first surface of the mounting base, and the fourth side of each liquid guiding wall is arranged apart from the inner surface of the bottom wall of the first liquid flowing channel.

Each liquid guiding wall includes a first side, a second side opposite to the first side, and a third side and a fourth side that are adjacent to the first side; and the first side and the second side of each liquid guiding wall are arranged apart from the inner surface of the side wall of the first liquid flowing channel, the third sides of each liquid guiding wall is flush with or lower than the first surface of the mounting base, and the fourth side of each liquid guiding wall is connected with the inner surface of the bottom wall of the first liquid flowing channel.

The guide grooves are grooves provided on the inner surface of the first liquid flowing channel, and the grooves extend in the axial direction of the first liquid flowing channel.

The guide grooves extend from the first surface of the mounting base to the inner surface of the bottom wall of the first liquid flowing channel.

A liquid guiding groove is further provided on the inner surface of the bottom wall of the mounting base, and the liquid guiding groove is in communication with the guide grooves and is configured to guide the liquid to the outside of the first liquid flowing channel.

To resolve the foregoing technical problem, another technical solution adopted by this application is to provide an electronic vaporization device, the electronic vaporization device includes: a vaporization assembly and a power supply component, where the power supply component is connected with the vaporization assembly and supplies power to the vaporization assembly, and the vaporization assembly is the vaporization assembly mentioned above.

In the vaporization assembly and the electronic vaporization device provided by this application, the vaporization assembly uses the liquid storage cavity to store the liquid by arranging the vaporization sleeve and forming the liquid storage cavity in the vaporization sleeve. Meanwhile, by arranging the mounting base in the vaporization sleeve and providing the first liquid flowing channel and the second liquid flowing channel in the mounting base in the direction facing the liquid storage cavity, the liquid in the liquid storage cavity can flow through the first liquid flowing channel and the second liquid flowing channel into the vaporization core. In addition, the liquid can flow in the direction toward the vaporization core by providing the several guide grooves on the wall surface of the first liquid flowing channel of the mounting base so as to destroy the surface tension of the liquid flowing through the first liquid flowing channel by using the structure of the guide grooves, and absorb and guide the liquid in the liquid storage cavity by the capillary force of the guide grooves. Furthermore, because in the first liquid flowing channel and the second liquid flowing channel, the several guide grooves are provided only on the wall surface of the first liquid flowing channel, so that the first liquid flowing channel and the second liquid flowing channel are asymmetrical in structure, the asymmetrical structure can destroy force balance of the bubbles at the bottoms of the liquid flowing channels, thereby preventing the bubbles from staying in and blocking the liquid flowing channels, avoiding affecting the ventilation performance of the vaporization assembly, and ensuring that the liquid can smoothly enter the vaporization core.

The following clearly and completely describes the technical solutions in the embodiments of this application with reference to the accompanying drawings in the embodiments of this application. Apparently, the described embodiments are merely some but not all of the embodiments of this application. All other embodiments obtained by a person of ordinary skill in the art based on the embodiments of this application without creative efforts fall within the protection scope of this application.

The terms "first", "second", and "third" are merely intended for a purpose of description, and shall not be understood as indicating or implying relative importance or implicitly indicating the number of indicated technical features. Therefore, features defined by "first", "second", or "third" may explicitly indicate or implicitly include at least one of the features. In the description of this application, unless otherwise specified, "plurality" means at least two, such as two, three, etc. All directional indications (for example, up, down, left, right, front, back . . . ) in the embodiments of this application are only used for explaining relative position relationships, movement situations, or the like between various components in a specific posture (as shown in the accompanying drawings). If the specific posture changes, the directional indications change accordingly. Furthermore, the terms "include" and "comprise" and any variations thereof are intended to cover non-exclusive inclusion. For example, a process, method, system, product, or device that includes a series of steps or units is not limited to the listed steps or units; and instead, further optionally includes a step or unit that is not listed, or further optionally includes another step or unit that is intrinsic to the process, method, product, or device.

"Embodiment" mentioned in the specification means that particular features, structures, or characteristics described with reference to the embodiment may be included in at least one embodiment of this application. The term appearing at different positions of the specification may not refer to the same embodiment or an independent or alternative embodiment that is mutually exclusive with another embodiment. A person skilled in the art explicitly or implicitly understands that the embodiments described in the specification may be combined with other embodiments.

The following describes this application in detail with reference to the accompanying drawings and embodiments.

Figure 2:
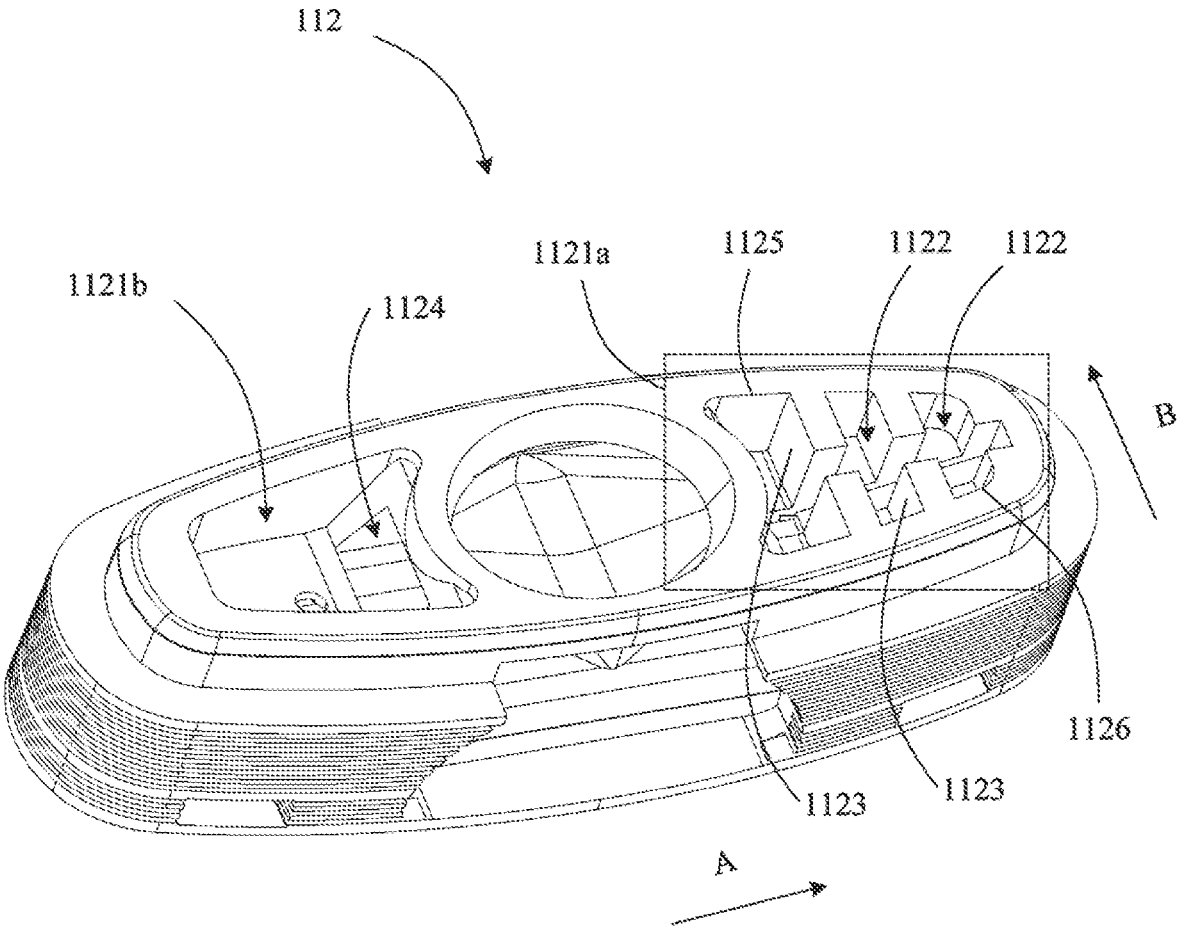
FIG. 2 is a schematic diagram of an overall structure of a mounting base according to an embodiment of this application.

Referring to FIG. 1 to FIG. 2, FIG. 1 is a schematic structural diagram of a vaporization assembly according to an embodiment of this application; and FIG. 2 is a schematic diagram of an overall structure of a mounting base according to an embodiment of this application. A vaporization assembly 10 is provided in this embodiment. The vaporization assembly 10 may specifically be configured to vaporize liquid and generate vapor for application in different fields, for example, medical treatment, e-cigarettes, etc. In a specific embodiment, the vaporization assembly 10 may be applied to an electronic vaporization device of an e-cigarette for vaporizing e-liquid and generating vapor for inhalation by an inhaler, which is taken as an example in all the following embodiments. Certainly, in other embodiments, the vaporization assembly 10 may also be applied to a hair spray device to vaporize a hair spray for hair styling, or applied to a medical device for treating upper and lower respiratory system diseases to vaporize medical drugs.

Specifically, the vaporization assembly 10 includes a vaporization sleeve 11, where the vaporization sleeve 11 may specifically be a hollow tubular structure, in which a liquid storage cavity 111 is formed. The liquid storage cavity 111 is specifically configured to store liquid, such as e-liquid. Specifically, a mounting base 112 and a vaporization core 113 are further embedded in the vaporization sleeve 11.

The mounting base 112 is arranged on a side of the liquid storage cavity 111 in the axial direction of the vaporization sleeve 11, the vaporization core 113 is arranged on a side of the mounting base 112 away from the liquid storage cavity 111, and a first liquid flowing channel 1121*a* and a second liquid flowing channel 1121*b* are provided on the mounting base 112 in a direction facing the liquid storage cavity 111. The first liquid flowing channel 1121*a* and the second liquid flowing channel 1121*b* are in communication with the liquid storage cavity 111 and the vaporization core 113, so that the liquid in the liquid storage cavity 111 can flow through the first liquid flowing channel 1121*a* and the second liquid flowing channel 1121*b* into the vaporization core 113. Specifically, the first liquid flowing channel 1121*a* and the second liquid flowing channel 1121*b* both include a side wall and a bottom wall, and a through hole 1124 is provided at the edges of the bottom walls to communicate the liquid storage cavity 111 with the vaporization core 113 through the through hole 1124. Specifically, cross-sections of the first liquid flowing channel 1121*a* and the second liquid flowing channel 1121*b* may be circular or in an irregular trapezoid shape.

Specifically, in the first liquid flowing channel 1121*a* and the second liquid flowing channel 1121*b*, several guide grooves 1122 are provided only on the wall surface of the first liquid flowing channel 1121*a*, so as to destroy surface tension of liquid flowing through the first liquid flowing channel 1121*a* by using a structure of the guide grooves 1122. Meanwhile, the liquid in the liquid storage cavity 111 is absorbed and guided by a capillary force of the guide grooves 1122, so that the liquid flows in the direction toward the vaporization core 113, and no guide groove 1122 is formed in the second liquid flowing channel 1121*b*. In a specific embodiment, the wall surface of the second liquid flowing channel 1121*b* is a smooth wall surface to facilitate rising of bubbles generated by ventilation to the liquid storage cavity 111. Meanwhile, the second liquid flowing channel 1121*b* and the first liquid flowing channel 1121*a* form an asymmetric structure, which destroy force balance of the bubbles at the bottoms of the liquid flowing channels, thereby preventing the bubbles from staying in and blocking the liquid flowing channels, avoiding affecting the ventilation performance of the vaporization assembly 10, and ensuring that the liquid can smoothly enter the vaporization core 113.

It may be understood that a flowing power of the liquid in the first liquid flowing channel 1121*a* mainly comes from gravity of the liquid itself and the capillary force of the guide grooves 1122, while a flowing power of liquid in the second liquid flowing channel 1121*b* mainly comes from gravity of the liquid itself. The flowing power of the liquid in the second liquid flowing channel 1121*b* is less than that of the liquid in the first liquid flowing channel 1121*a*. Therefore, the liquid in the liquid storage cavity 111 mainly flows through the first liquid flowing channel 1121*a* into the vaporization core 113. Furthermore, it may be understood that the bubbles generated by ventilation bear greater rising resistance in the first liquid flowing channel 1121*a* than in the second liquid flowing channel 1121*b*. Therefore, the bubbles rise into the liquid storage cavity 111 mainly through the second liquid flowing channel 1121*b*, so that most of the liquid in the liquid storage cavity 111 and most of the bubbles generated by ventilation can pass through different liquid flowing channels. In this way, the bubbles and the liquid flow through different channels, which effectively avoids a problem that the liquid cannot enter the vaporization core 113 due to blocked liquid flowing channels caused by the bubbles, thereby preventing a heating film in the vaporization core 113 from dry heating.

In an embodiment, the guide grooves 1122 may specifically be formed by arrangement at intervals of several liquid guiding walls 1123 protruding from the inner surface of the first liquid flowing channel 1121*a*, and the several liquid guiding walls 1123 extend in the axial direction of the first liquid flowing channel 1121*a*.

Figure 3:
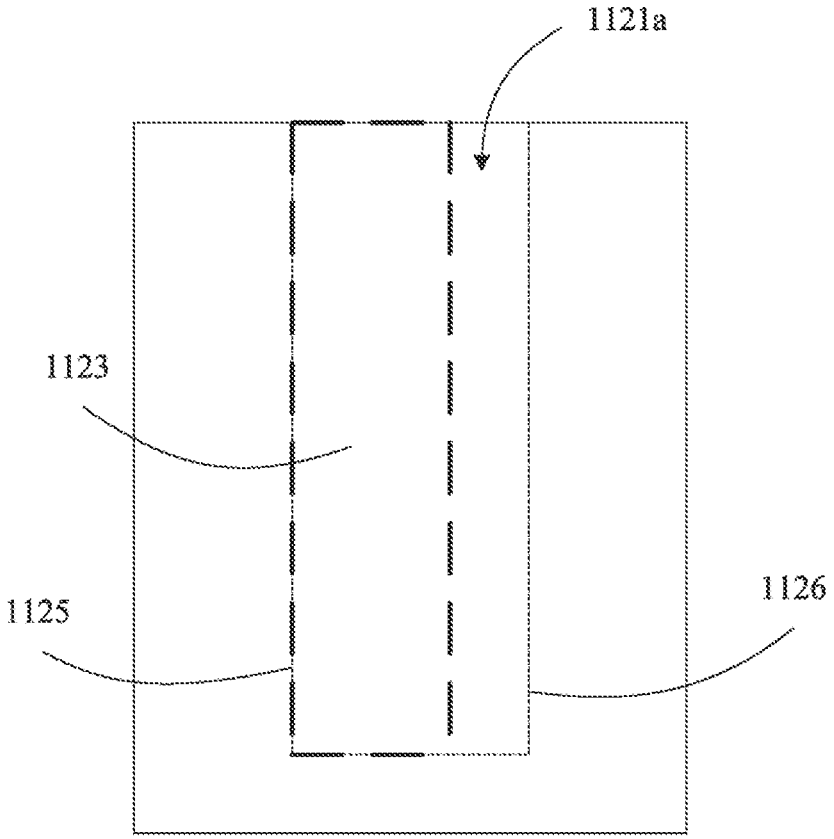
FIG. 3 is a schematic diagram of a liquid guiding wall arranged on a side wall of a first liquid flowing channel according to an embodiment of this application.
Figure 4:
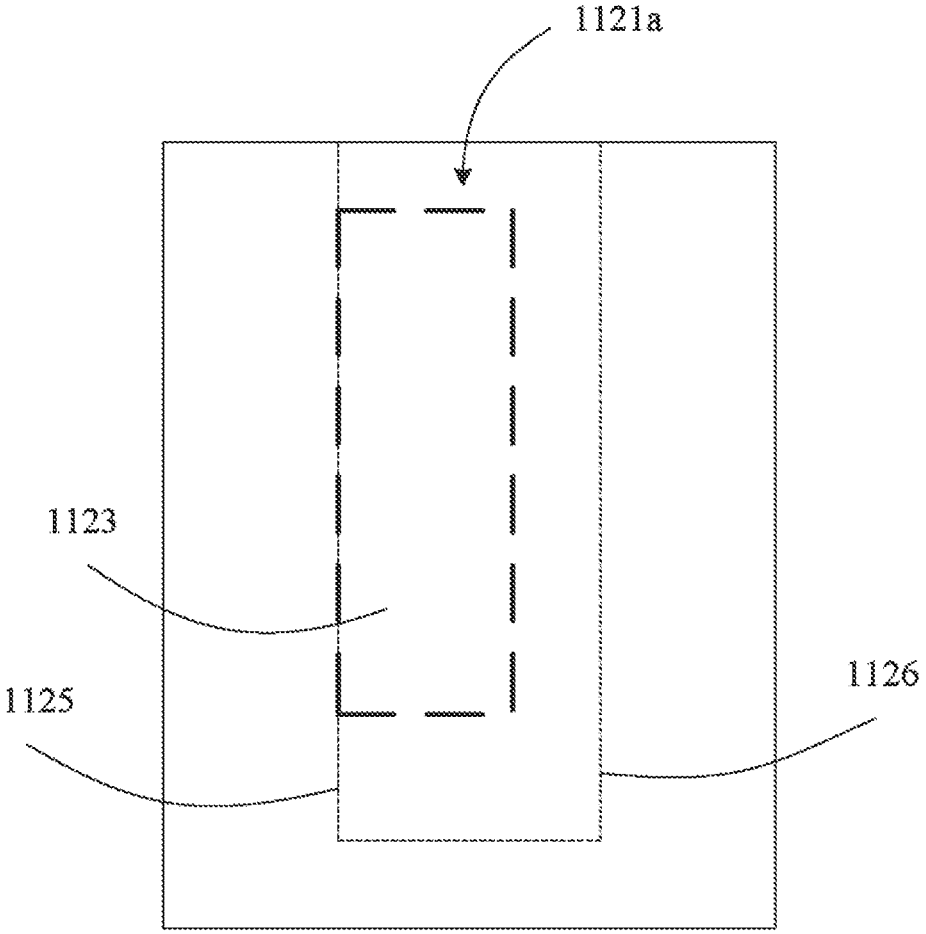
FIG. 4 is a schematic diagram of a liquid guiding wall arranged on a side wall of a first liquid flowing channel according to another embodiment of this application.

It should be noted that FIG. 3, FIG. 4, and FIG. 8 involved in the following embodiments of this application are all A-direction views of the mounting base 112. In a specific embodiment, referring to FIG. 3 and FIG. 4, FIG. 3 is a schematic diagram of a liquid guiding wall arranged on a side wall of a first liquid flowing channel according to an embodiment of this application; and FIG. 4 is a schematic diagram of a liquid guiding wall arranged on a side wall of a first liquid flowing channel according to another embodiment of this application. Each liquid guiding wall 1123 includes a first side, a second side opposite to the first side, and a third side and a fourth side that are adjacent to the first side. The side wall of the first liquid flowing channel 1121*a* includes a first inner surface 1125 and a second inner surface 1126 opposite to the first inner surface 1125. Referring to FIG. 4, the side of each liquid guiding wall 1123 in contact with the inner surfaces of the side wall of the first liquid flowing channel 1121*a* is defined as the first side. In this embodiment, the first side of each liquid guiding wall 1123 is connected with one of the first inner surface 1125 and the second inner surface 1126 of the first liquid flowing channel 1121*a*, the second side of each liquid guiding wall 1123 is arranged apart from the other of the first inner surface 1125 and the second inner surface 1126 of the first liquid flowing channel 1121*a*, and the third side of each liquid guiding wall 1123 is flush with (refer to FIG. 3) or lower than (refer to FIG. 4) the first surface of the mounting base 112.

Further, the fourth side of each liquid guiding wall 1123 may be further connected with the bottom wall of the first liquid flowing channel 1121*a* (refer to FIG. 3), so that the guide grooves 1122 run through the bottom of the first liquid flowing channel 1121*a*, thereby continuously destroying the surface tension of the liquid in the first liquid flowing channel 1121*a* by using the structure of the guide grooves 1122, and absorbing and guiding the liquid by the capillary force of the guide grooves 1122. Certainly, in other embodiments, the fourth side of each liquid guiding wall 1123 may also be arranged apart from the inner surface of the bottom wall of the first liquid flowing channel 1121*a* (refer to FIG. 4).

Figure 5:
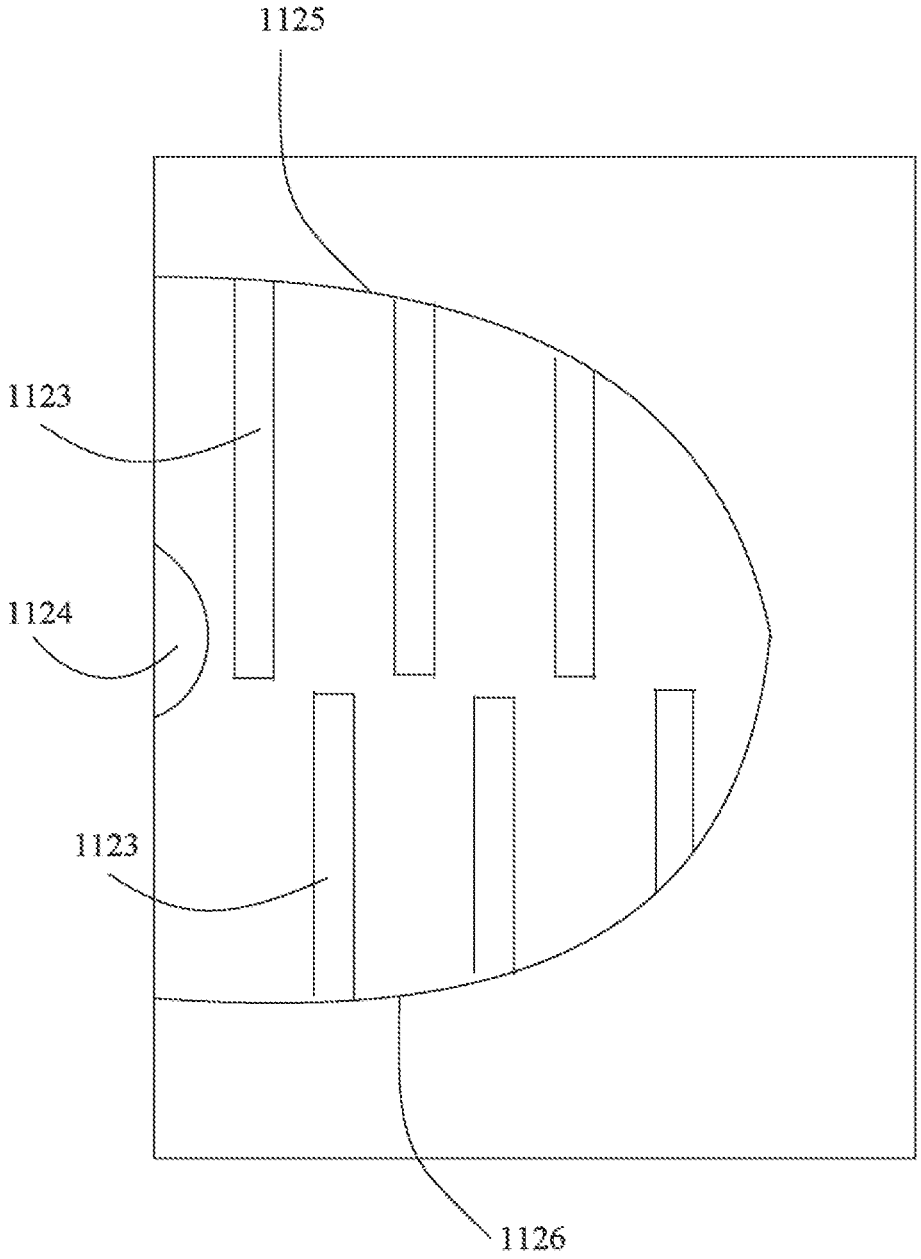
FIG. 5 is a schematic diagram of liquid guiding walls arranged in a staggered manner on two opposite inner surfaces of a first liquid flowing channel according to an embodiment of this application.

In another specific embodiment, referring to FIG. 2 and FIG. 5, FIG. 5 is a schematic diagram of liquid guiding walls arranged in a staggered manner on two opposite inner surfaces of a first liquid flowing channel according to an embodiment of this application. Several liquid guiding walls 1123 are arranged on the first inner surface 1125 and the second inner surface 1126 of the first liquid flowing channel 1121*a*. That is, in some liquid guiding walls 1123, the first sides are connected with the first inner surface 1125 of the first liquid flowing channel 1121*a*, and the second sides are arranged apart from the second inner surface 1126; and in the remaining liquid guiding walls 1123, the first sides are connected with the second inner surface 1126 of the first liquid flowing channel 1121*a*, and the second sides are arranged apart from the first inner surface 1125.

Further, in this embodiment, the liquid guiding walls 1123 connected with the first inner surface 1125 and the liquid guiding walls 1123 connected with the second inner surface 1126 are arranged in an opposite (refer to FIG. 2) or a staggered (refer to FIG. 5) manner.

Specifically, in this embodiment, the fourth side of each liquid guiding wall 1123 may also be connected with the bottom wall of the first liquid flowing channel 1121*a*, and for details, reference may be made to FIG. 2. In another embodiment, the fourth side of each liquid guiding wall 1123 may also be arranged apart from the inner surface of the bottom wall of the first liquid flowing channel 1121*a*. In this way, liquid in the guide grooves 1122 can flow to the through hole 1124 on the bottom wall of the first liquid flowing channel 1121*a* through a gap between the fourth side of each liquid guiding wall 1123 and the inner surface of the bottom wall of the first liquid flowing channel 1121*a* and a gap between the second side of each liquid guiding wall 1123 and the inner surface of the side wall of the first liquid flowing channel 1121*a*, thereby entering the vaporization core 113.

Figure 6:
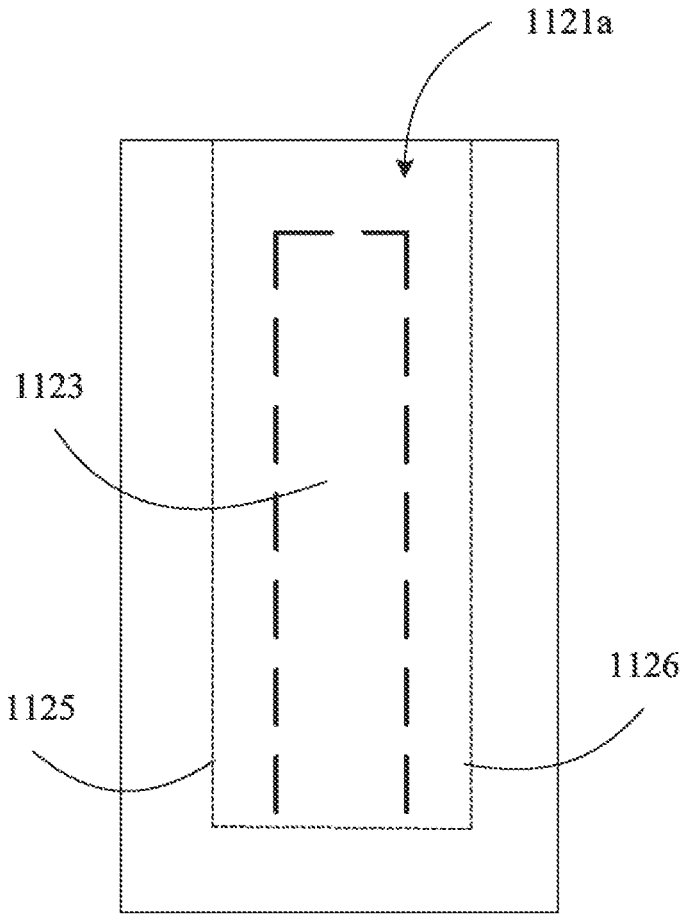
FIG. 6 is a schematic diagram of a liquid guiding wall arranged on a bottom wall of a first liquid flowing channel according to an embodiment of this application.
Figure 7:
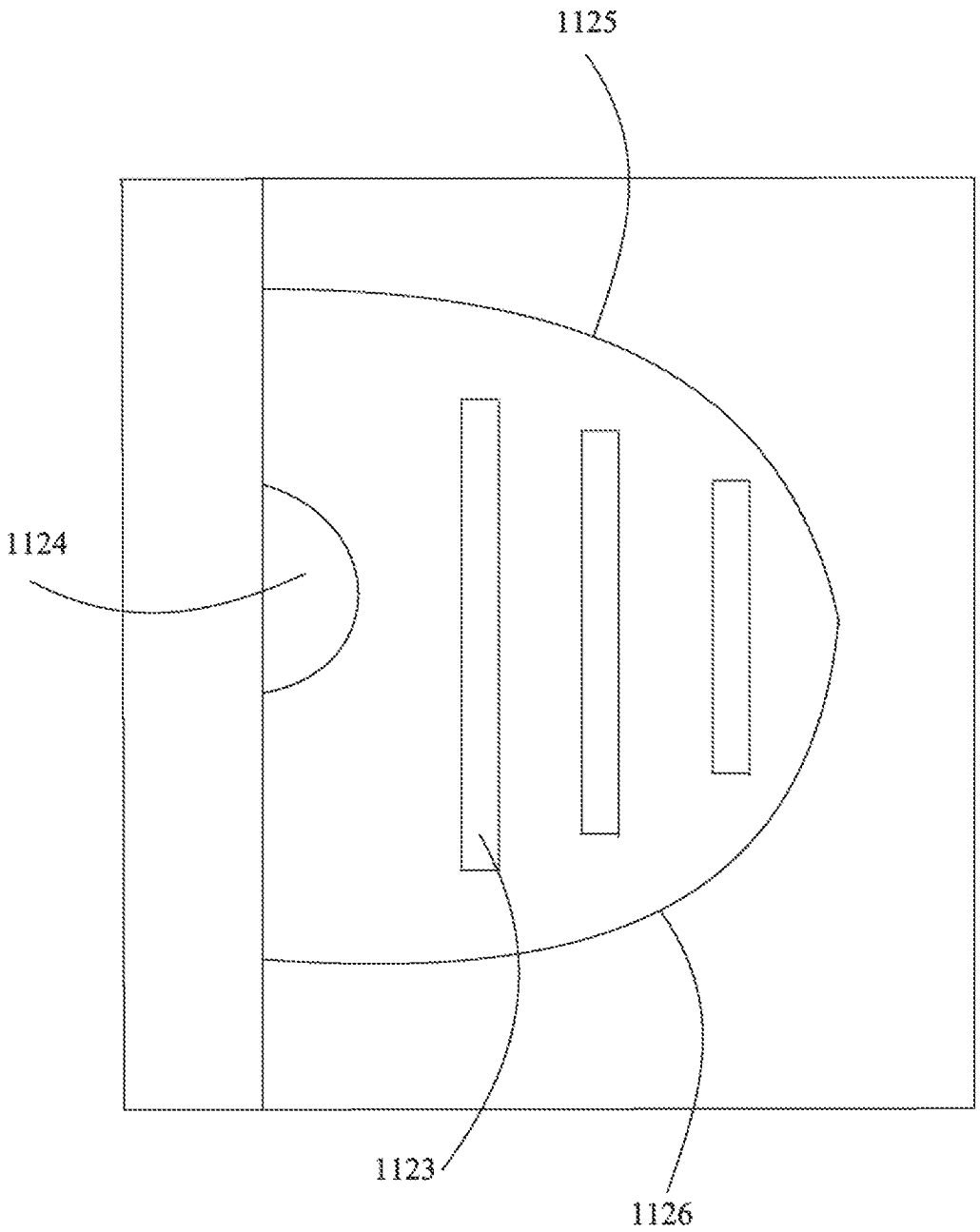
FIG. 7 is a top view of the first liquid flowing channel corresponding to FIG. 6.

In an embodiment, referring to FIG. 6 and FIG. 7, FIG. 6 is a schematic diagram of a liquid guiding wall arranged on a bottom wall of a first liquid flowing channel according to an embodiment of this application; and FIG. 7 is a top view of the first liquid flowing channel corresponding to FIG. 6. Specifically, the fourth side of the liquid guiding wall 1123 is connected with the inner surface of the bottom wall of the first liquid flowing channel 1121*a*, and the first side and the second side of the liquid guiding wall 1123 are respectively arranged apart from the first inner surface 1125 and the second inner surface 1126 of the first liquid flowing channel 1121*a*. Specifically, in this embodiment, the third side of the liquid guiding wall 1123 is flush with or lower than the first surface of the mounting base 112, and several liquid guiding walls 1123 may be arranged in an array in the first liquid flowing channel 1121*a*, specifically, in one row and multiple columns, such as one row and three columns, where the first surface of the mounting base 112 specifically refers to the side surface of the mounting base 112 close to the liquid storage cavity 111.

Figure 8:
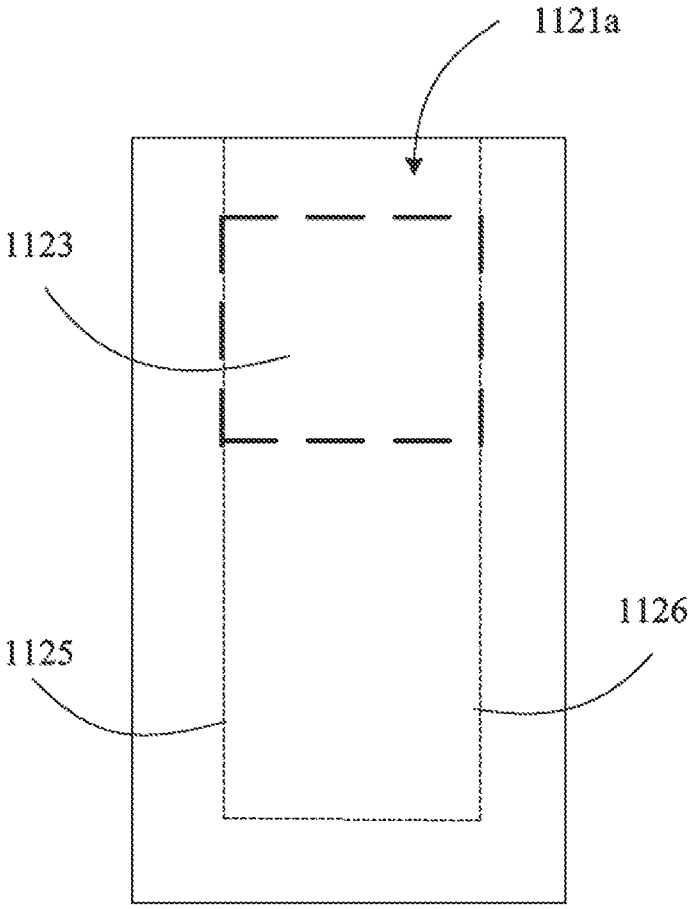
FIG. 8 is a schematic diagram of a liquid guiding wall arranged on a side wall of a first liquid flowing channel according to still another embodiment of this application.

In an embodiment, referring to FIG. 8, FIG. 8 is a schematic diagram of a liquid guiding wall arranged on a side wall of a first liquid flowing channel according to another embodiment of this application. Specifically, the first side and the second side of the liquid guiding wall 1123 are respectively connected with the first inner surface 1125 and the second inner surface 1126 of the first liquid flowing channel 1121*a*, and the fourth side of the liquid guiding wall 1123 is arranged apart from the inner surface of the bottom wall of the first liquid flowing channel 1121*a*, so that the liquid in the guide grooves 1122 formed by the liquid guiding walls 1123 can flow to the through hole 1124 through a gap between the fourth side of each liquid guiding wall 1123 and the inner surface of the bottom wall of the first liquid flowing channel 1121*a*. Specifically, the third side of each liquid guiding wall 1123 is flush with or lower than the first surface of the mounting base 112.

Specifically, in an embodiment, the foregoing liquid guiding walls 1123 may be integrally formed with the side wall where the inner surfaces of the first liquid flowing channel 1121 *a* are arranged. In another embodiment, for the existing mounting base 112 in which both the two first liquid flowing channel 1121 *a* includes a smooth inner surface, the foregoing liquid guiding walls 1123 may be fixed to one of the inner surface of the first liquid flowing channel 1121 *a* by gluing, so as to change the two first liquid flowing channels into an asymmetric structure.

The liquid guiding walls 1123 may specifically be thin plates. In a specific embodiment, the width of each guide groove 1122 formed by the liquid guiding walls 1123 may be less than 1.5 mm, and the depth of each guide groove 1122 may be selected according to an actual requirement and is not limited in this embodiment.

Figure 9:
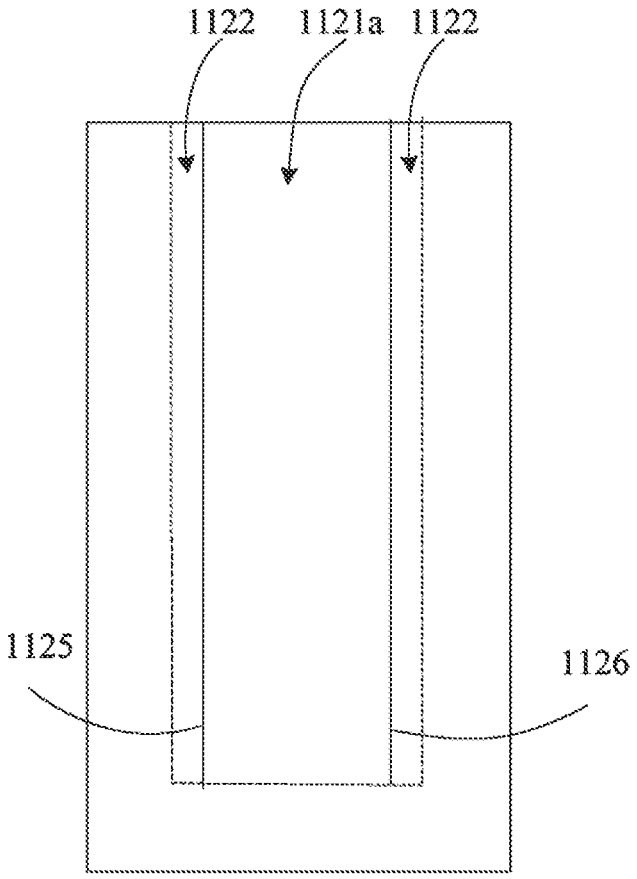
FIG. 9 is an A-direction view of a liquid guide groove in a first liquid flowing channel being a groove according to an embodiment of this application.
Figure 10:
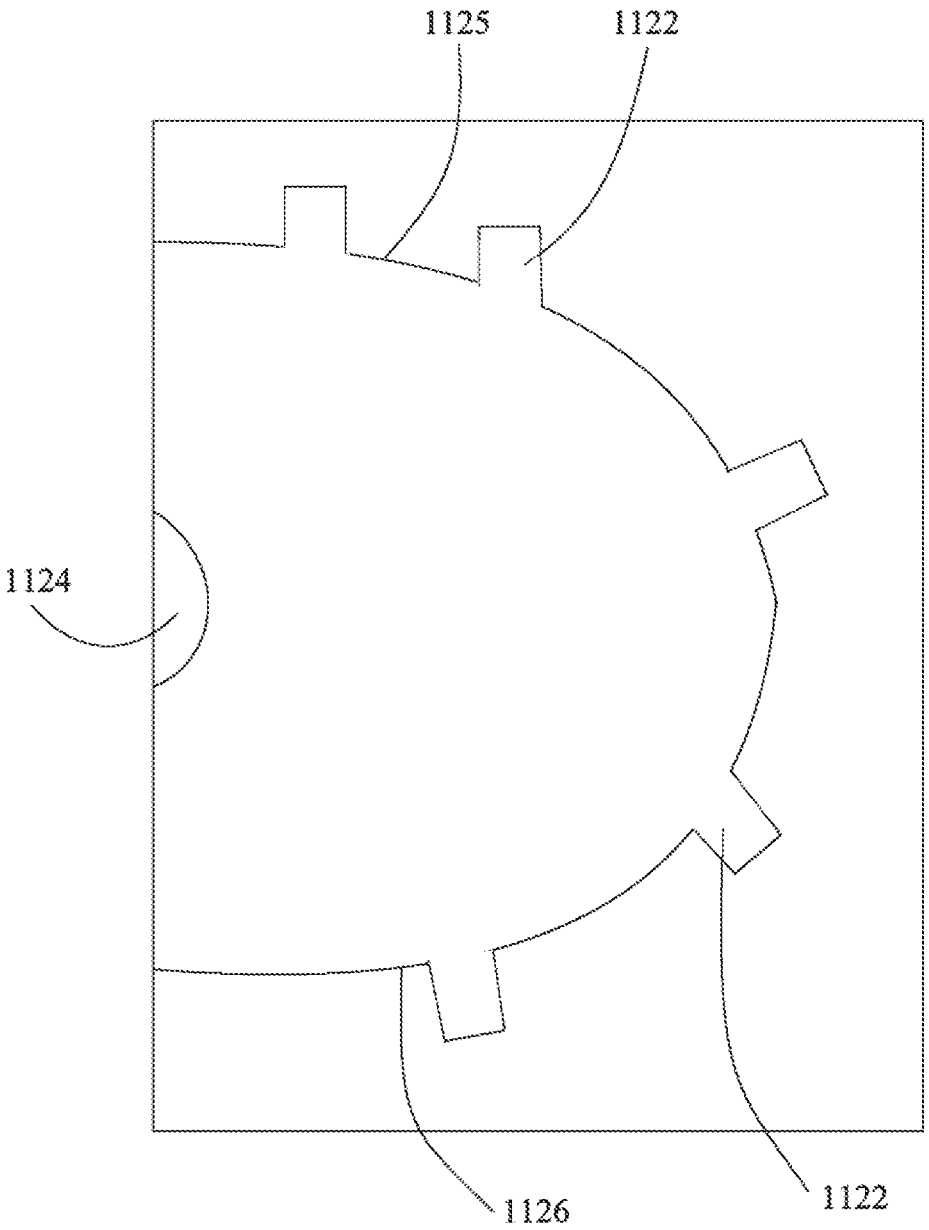
FIG. 10 is a top view of the first liquid flowing channel corresponding to FIG. 9.

Referring to FIG. 2, FIG. 9, and FIG. 10, FIG. 9 is an A-direction view of a liquid guide groove in a first liquid flowing channel being a groove according to an embodiment of this application; and FIG. 10 is a top view of the first liquid flowing channel corresponding to FIG. 9. In this embodiment, the guide grooves 1122 may specifically be grooves provided on the inner surface of the first liquid flowing channel 1121*a*, and the grooves extend in the axial direction of the first liquid flowing channel 1121*a*. The guide grooves 1122 corresponding to this embodiment not only have a simple manufacturing process, but also save use of the liquid guiding walls 1123, thereby reducing production costs.

Specifically, the foregoing grooves may extend from the first surface of the mounting base 112 to the inner surface of the bottom wall of the first liquid flowing channel 1121*a*, so as to guide the liquid entering the first liquid flowing channel 1121*a* directly onto the inner surface of the bottom wall of the first liquid flowing channel 1121*a*, thereby continuously destroying the surface tension of the liquid flowing through the corresponding first liquid flowing channel 1121*a*.

Further, a liquid guiding groove is further provided on the inner surface of the bottom wall of the mounting base 112, and the liquid guiding groove is in communication with the guide grooves 1122 for guiding the liquid to the outside of the first liquid flowing channel 1121*a*.

Certainly, in a specific embodiment, both liquid guiding walls 1123 and grooves may be arranged in the first liquid flowing channel 1121*a* of the mounting base 112, and for details, reference may be made to FIG. 2, so as to reduce the production costs while improving the liquid guiding performance.

In the vaporization assembly 10 provided by this embodiment, the liquid storage cavity 111 is used to store liquid by arranging the vaporization sleeve 11 and forming the liquid storage cavity 111 in the vaporization sleeve 11 Meanwhile, by arranging the mounting base 112 in the vaporization sleeve 11 and providing the first liquid flowing channel 1121*a* and the second liquid flowing channel 1121*b* in the mounting base 112 in a direction facing the liquid storage cavity 111, the liquid in the liquid storage cavity 111 can flow through the first liquid flowing channel 1121*a* and the second liquid flowing channel 1121*b* into the vaporization core 113. In addition, the liquid can flow in a direction toward the vaporization core 113 by providing several guide grooves 1122 on the wall surface of the first liquid flowing channel 1121*a* of the mounting base 112 so as to destroy the surface tension of the liquid flowing through the first liquid flowing channel 1121*a* by using the structure of the guide grooves 1122, and absorb and guide the liquid in the liquid storage cavity 111 by a capillary force of the guide grooves 1122. Furthermore, because in the first liquid flowing channel 1121*a* and the second liquid flowing channel 1121*b*, the several guide grooves 1122 are provided only on the wall surface of the first liquid flowing channel 1121*a*, so that the first liquid flowing channel 1121*a* and the second liquid flowing channel 1121*b* form an asymmetrical structure, which is used to destroy the force balance of the bubbles at the bottom of the liquid flowing channels, thereby preventing the bubbles from staying in and blocking the liquid flowing channels, avoiding affecting the ventilation performance of the vaporization assembly 10, and ensuring that the liquid can smoothly enter the vaporization core 113.

In an embodiment, the mounting base 112 may further include several other liquid flowing channels, where guide grooves 1122 may be provided in all or a part of the several other liquid flowing channels so as to guide the liquid of the liquid storage cavity 111 in the direction toward the vaporization core 113 by a capillary force of the guide grooves 1122. Alternatively, the wall surfaces of these liquid flowing channels may be smooth wall surfaces to facilitate rising of the bubbles into the liquid storage cavity 111.

In an embodiment, different from the foregoing embodiment, several guide grooves 1122 are provided in each liquid flowing channel of the mounting base 112, and a capillary force corresponding to each liquid flowing channel is different, so that at least two liquid flowing channels are asymmetrical in structure. That is, the several guide grooves 1122 are provided in each liquid flowing channel, and have different liquid absorbing forces on the liquid in the liquid storage cavity 111. In this way, the liquid in the liquid storage cavity 111 tends to flow into a liquid flowing channel with a greater capillary force while the bubbles tend to enter the liquid storage cavity 111 through a liquid flowing channel with a smaller capillary force. Therefore, the liquid and the bubbles pass through different channels, thereby preventing a problem that the liquid cannot enter the vaporization core 113 due to blocked liquid flowing channels caused by the bubbles. In the mounting base 112 provided in this embodiment, all the liquid flowing channels arranged in mounting base 112 can use the guide grooves 1122 to guide liquid entering the liquid flowing channels and destroy the surface tension of the liquid flowing through the corresponding liquid flowing channels. Meanwhile, an asymmetric structure of at least two liquid flowing channels can be used to destroy the force balance of the bubbles at the bottoms of the liquid flowing channels, thereby preventing the bubbles from staying in and blocking the liquid flowing channels, avoiding affecting the ventilation performance of the vaporization assembly 10, and ensuring that the liquid can enter the vaporization core 113 smoothly.

Specifically, in this embodiment, for the specific structure and arrangement manner of the guide grooves 1122, reference may be made to related description of the guide grooves 1122 in the foregoing embodiment where the guide grooves 1122 are provided only in a part of the liquid flowing channels. The same or similar technical effects can be achieved, and details are not described herein again, as long as the capillary force corresponding to each liquid flowing channel is different, and the at least two liquid flowing channels form an asymmetric structure.

Figure 11:
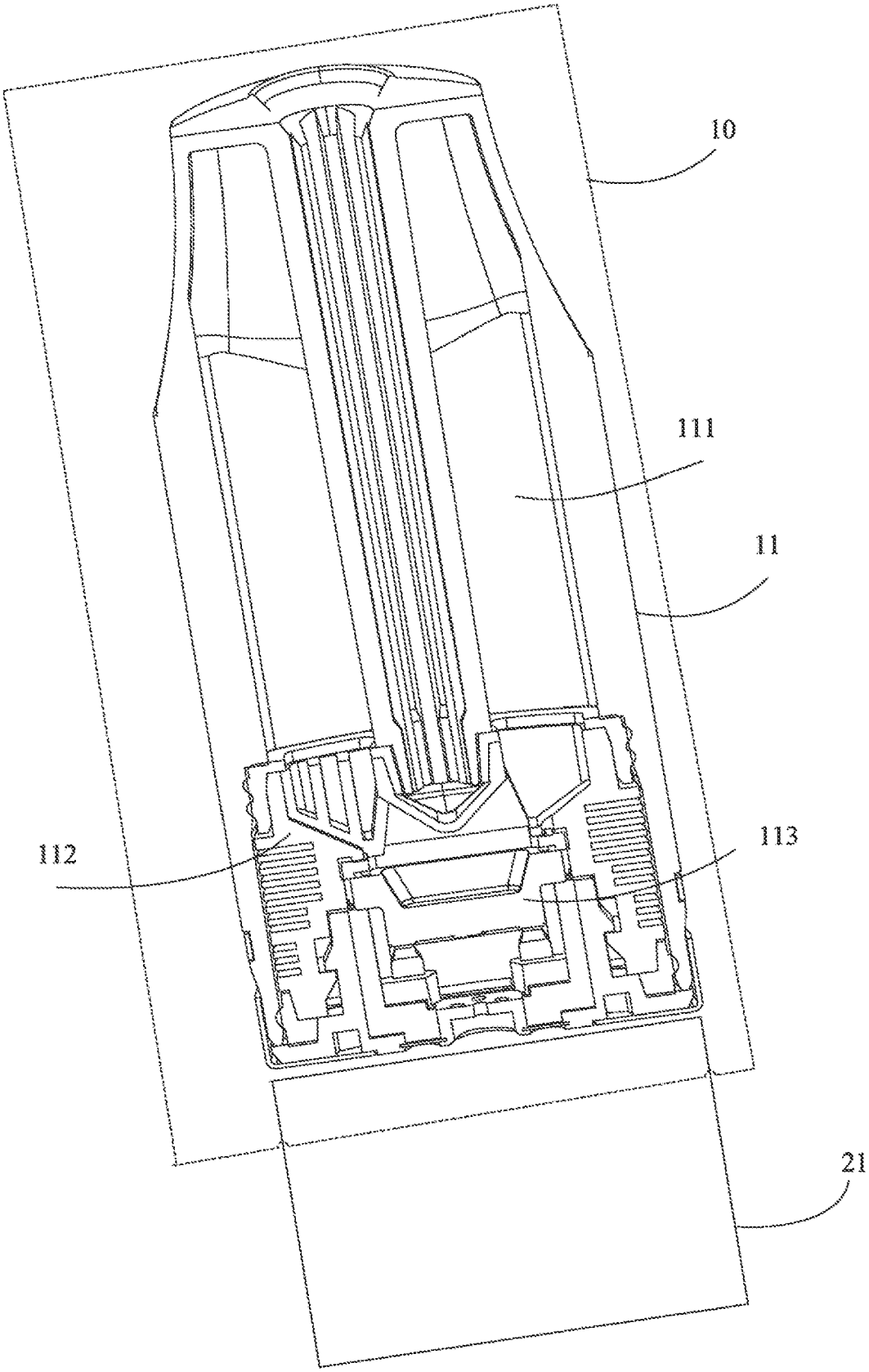
FIG. 11 is a schematic structural diagram of an electronic vaporization device according to an embodiment of this application.
Figure 12:
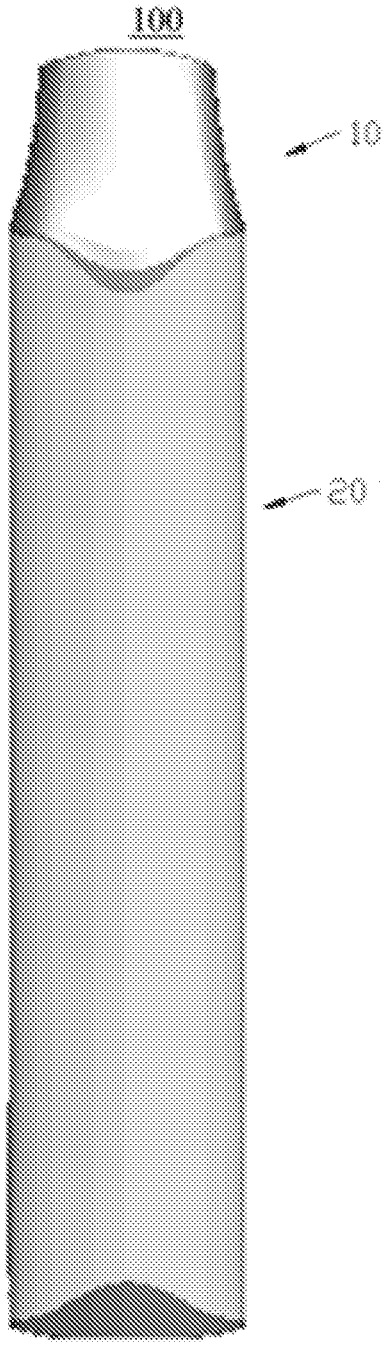
FIG. 12 is a schematic diagram of an overall structure of an electronic vaporization device according to an embodiment of this application.

Referring to FIG. 11 and FIG. 12, FIG. 11 is a schematic structural diagram of an electronic vaporization device according to an embodiment of this application; and FIG. 12 is a schematic diagram of an overall structure of an electronic vaporization device according to an embodiment of this application. In this embodiment, an electronic vaporization device 100 is provided for vaporizing a liquid substrate such as e-liquid and medicine liquid; and in an embodiment, the electronic vaporization device 100 may specifically be an e-cigarette.

The electronic vaporization device 100 may specifically include a vaporization assembly 10 and a main unit 20. A power supply component 21 is arranged in the main unit 20, and the vaporization assembly 10 is inserted in a port at an end of the main unit and is connected with the power supply component 21 in the main unit 20, so as to supply power to the vaporization assembly 10 through the power supply component 21.

Specifically, for the specific structure and functions of the vaporization assembly 10, reference may be made to the vaporization assembly 10 provided in the foregoing embodiment. The same or similar technical effects can be achieved, and for details, reference may be made to the foregoing text description, which are not described herein again.

Certainly, the electronic vaporization device 100 further includes other components in the existing electronic vaporization devices, such as a vaporization core, a holder, a base, and the like. The specific structures and functions of these components are the same as or similar to those of the components in the related art. For details, reference may be made to the related art, which are not described herein again.

In the electronic vaporization device 100 provided by this embodiment, a liquid storage cavity 111 is used to store liquid by arranging the vaporization assembly 10 to include a vaporization sleeve 11 and forming the liquid storage cavity 111 in the vaporization sleeve 11. Meanwhile, by arranging a mounting base 112 in the vaporization sleeve 11 and providing a first liquid flowing channel 1121*a* and a second liquid flowing channel 1121*b* in the mounting base 112 in a direction facing the liquid storage cavity 111, the liquid in the liquid storage cavity 111 can flow through the first liquid flowing channel 1121*a* and the second liquid flowing channel 1121*b* into a vaporization core 113. In addition, the liquid can flow in a direction toward the vaporization core 113 by providing several guide grooves 1122 on the wall surface of the first liquid flowing channel 1121*a* of the mounting base 112 so as to destroy the surface tension of the liquid flowing through the first liquid flowing channel 1121*a* by using a structure of the guide grooves 1122, and absorb and guide the liquid in the liquid storage cavity 111 by a capillary force of the guide grooves 1122. Furthermore, because in the first liquid flowing channel 1121*a* and the second liquid flowing channel 1121*b*, the several guide grooves 1122 are provided only on the wall surface of the first liquid flowing channel 1121*a*, so that the first liquid flowing channel 1121*a* and the second liquid flowing channel 1121*b* form an asymmetrical structure, and the asymmetrical structure can destroy the force balance of the bubbles at the bottoms of the liquid flowing channels, thereby preventing the bubbles from staying in and blocking the liquid flowing channels, avoiding affecting the ventilation performance of the vaporization assembly 10, and ensuring that the liquid can smoothly enter the vaporization core 113.

The foregoing is merely implementations of this application but is not intended to limit the patent scope of this application. Any equivalent structural or process change made by using the content of the specification and the accompanying drawings of this application for direct or indirect use in other relevant technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporization assembly, comprising:

a vaporization sleeve comprising a liquid storage cavity configured to store liquid; and a mounting base embedded in the vaporization sleeve, a first liquid flowing channel and a second liquid flowing channel being provided in the mounting base in a direction facing the liquid storage cavity, wherein a plurality of guide grooves are provided on a wall surface of the first liquid flowing channel such that the first liquid flowing channel and the second liquid flowing channel are asymmetrical in structure, wherein the plurality of guide grooves are formed by arrangement at intervals of a plurality of liquid guiding walls protruding from an inner surface of the first liquid flowing channel, wherein each liquid guiding wall of the plurality of liquid guiding walls comprises a first side and a second side opposite the first side, and a side wall of the first liquid flowing channel comprises a first inner surface and a second inner surface opposite the first inner surface, wherein the first side of each liquid guiding wall is connected with one of the first inner surface and the second inner surface, and the second side of each liquid guiding wall is arranged apart from the other of the first inner surface and the second inner surface, wherein each liquid guiding wall further comprises a third side and a fourth side that are adjacent to the first side, and wherein the third side of each liquid guiding wall is flush with a first surface of the mounting base.

2. The vaporization assembly of claim 1, further comprising:

a vaporization core, wherein the plurality of guide grooves are configured to guide a liquid in the liquid storage cavity toward the vaporization core by a capillary force.

3. The vaporization assembly of claim 2, wherein a wall surface of the second liquid flowing channel comprises a smooth wall surface.

4. The vaporization assembly of claim 1, wherein a width of each guide groove of the plurality of guide grooves is less than 1.5 mm.

5. The vaporization assembly of claim 1, further comprising:

a plurality of other liquid flowing channels, wherein the plurality of guide grooves are provided in all or a part of the plurality of other liquid flowing channels.

6. The vaporization assembly of claim 1, further comprising:

a plurality of other liquid flowing channels, wherein wall surfaces of the plurality of other liquid flowing channels comprise smooth wall surfaces.

7. The vaporization assembly of claim 1, wherein the plurality of liquid guiding walls extend in an axial direction of the first liquid flowing channel.

8. The vaporization assembly of claim 1, wherein the fourth side of each liquid guiding wall is connected with the inner surface of a bottom wall of the first liquid flowing channel.

9. The vaporization assembly of claim 7, wherein the fourth side of each liquid guiding wall is arranged apart from the inner surface of a bottom wall of the first liquid flowing channel.

10. The vaporization assembly of claim 1, wherein the plurality of guide grooves comprise grooves provided on the inner surface of the first liquid flowing channel, and wherein the plurality of guide grooves extend in an axial direction of the first liquid flowing channel.

11. The vaporization assembly of claim 10, wherein the guide grooves extend from the first surface of the mounting base to the inner surface of a bottom wall of the first liquid flowing channel.

12. The vaporization assembly of claim 11, where a liquid guiding groove is provided on the inner surface of the bottom wall of the mounting base, the liquid guiding groove being in communication with the guide grooves and configured to guide a liquid to the outside of the first liquid flowing channel.

13. An electronic vaporization device, comprising:

the vaporization assembly of claim 1; and a power supply component, wherein the power supply component is connected with the vaporization assembly and configured to supply power to the vaporization assembly.

* * * * *